US009267764B2

(12) United States Patent
Seabrook

(10) Patent No.: US 9,267,764 B2
(45) Date of Patent: Feb. 23, 2016

(54) BALLISTIC SHIELD

(71) Applicant: Nathan Albert Seabrook, Minneapolis, MN (US)

(72) Inventor: Nathan Albert Seabrook, Minneapolis, MN (US)

(73) Assignee: Seabrook Tactical Equipment, LLC, Minneapolis, MN (US)

( * ) Notice: Subject to any disclaimer, the term of this patent is extended or adjusted under 35 U.S.C. 154(b) by 0 days.

(21) Appl. No.: 14/292,405

(22) Filed: May 30, 2014

(65) Prior Publication Data

US 2015/0233679 A1 Aug. 20, 2015

Related U.S. Application Data

(60) Provisional application No. 61/828,866, filed on May 30, 2013.

(51) Int. Cl.

| | |
|---|---|
| ***F41H 7/00*** | (2006.01) |
| ***F41H 5/08*** | (2006.01) |
| ***F41H 5/04*** | (2006.01) |
| ***F41H 5/12*** | (2006.01) |

(52) U.S. Cl.

CPC ..... *F41H 5/08* (2013.01); *F41H 5/0407* (2013.01); *F41H 5/0478* (2013.01); *F41H 5/12* (2013.01)

(58) Field of Classification Search

USPC ..... 89/36.07, 36.06, 36.05

See application file for complete search history.

(56) References Cited

U.S. PATENT DOCUMENTS

| | | | | |
|---|---|---|---|---|
| 3,866,242 | A | 2/1975 | Slagel | |
| 4,843,947 | A | 7/1989 | Bauer et al. | |
| 6,595,101 | B2 | 7/2003 | Baker | |
| 6,886,446 | B1 | 5/2005 | Baker | |
| 7,520,206 | B2 | 4/2009 | Baker | |
| 8,015,910 | B1 * | 9/2011 | Fuqua | F41H 5/14 89/36.01 |
| 8,584,571 | B2 | 11/2013 | Armellino, Jr. | |
| 2009/0025546 | A1 * | 1/2009 | White | F41H 5/08 89/36.02 |
| 2010/0083820 | A1 * | 4/2010 | Doyner | F41H 5/08 89/36.02 |
| 2013/0051778 | A1 * | 2/2013 | Dimotakis | B64D 47/08 396/12 |
| 2014/0238225 | A1 * | 8/2014 | Mickiewicz | F41H 5/08 89/36.07 |

OTHER PUBLICATIONS

Baker Ballistics, LLC; Baker Batshield; site accessed Aug. 29, 2014; http://www.bakerballistics.com/batshield/.

Armchair General; KV-1 identification threat; site accessed Aug. 29, 2014; http://www.armchairgeneral.com/forums/showthread.php?p=1211819.

W.W. Grainger, Inc.; Grainger; Ballistic Shield; accessed Aug. 29, 2014; http://www.grainger.com/product/GH-ARMOR-SYSTEMS-Ballistic-Shield-20UM27?s_pp=false&picUrl=//static.grainger.com/rp/s/is/image/Grainger/20UM26_AS01?$smthumb$.

* cited by examiner

*Primary Examiner* — J. Woodrow Eldred

(74) *Attorney, Agent, or Firm* — Adams Grumbles, LLP; Brittany Nanzig

(57) ABSTRACT

A portable ballistic shield for law enforcement, military, and private security contractors operating in high threat cases. More specifically, a ballistic shield with a viewing window, a handle, a ball turret, an aiming laser, and at least one disruptor light used to disorient possible attackers. The shield provides protection to a user's entire upper body and enables a user to fire from a position in which the head of the user is better aligned with the weapon site.

19 Claims, 11 Drawing Sheets

BALLISTIC SHIELD

CROSS-REFERENCE TO RELATED APPLICATIONS

This application claims the benefit of U.S. Provisional Application No. 61/828,866 filed May 30, 2013, titled BALLISTIC SHIELD.

FIELD OF THE DISCLOSURE

The present disclosure pertains to a portable ballistic shield for use by law enforcement, military and private security contractors operating in high threat areas.

BACKGROUND OF THE INVENTION

Law enforcement, military and civilian high threat security contractors have a need for protective gear when they respond to active shooter situations, acts of terrorism, military operations, high threat warrants, arrests and other acts of violence that require specialized equipment. The need for a portable lightweight ballistic shield that provides added protection to the military, security and law enforcement operator is imperative.

Conventional ballistic shields typically require that the operator expose his or her hand or arm to return fire. In addition, conventional ballistic shields often require the operator to return fire from a position in which the head of the operator is not aligned with the weapon site. The present disclosure provides an improved ballistic shield and related methods that address the above shortcomings and others.

SUMMARY OF THE INVENTION

According to one embodiment of the present disclosure, a ballistic shield is provided having a ballistic glass window, a handle used for holding the shield in front of the user's body, a quick release harness strap that clips around the user's shoulders/arms for additional stabilization, a ball turret with aiming laser, a quick release sleeve system that enables various weapon platforms to interchangeably fit into the ball mount turret, and a series of high density LED disruptor lights used to disorient possible attackers. A method of using a ballistic shield is also provided.

BRIEF DESCRIPTION OF THE DRAWINGS

The advantages and features of the present disclosure will become better understood with reference to the following detailed description taken in conjunction with the accompanying drawings, wherein like elements are identified with like reference numerals, and in which.

DETAILED DESCRIPTION

The exemplary embodiments described herein in detail for illustrative purposes are subject to many variations in structure and design. It should be emphasized, however, that the present disclosure is not limited to a particular shield, as shown and described. It is understood that various omissions and substitutions of equivalents are contemplated as circumstances may suggest or render expedient, but these are intended to cover the application or embodiments without departing from the spirit or scope of the claims of the present disclosure. Also, it is to be understood that the phraseology and terminology used herein are for the purpose of description and should not be regarded as limiting.

Figure 1:
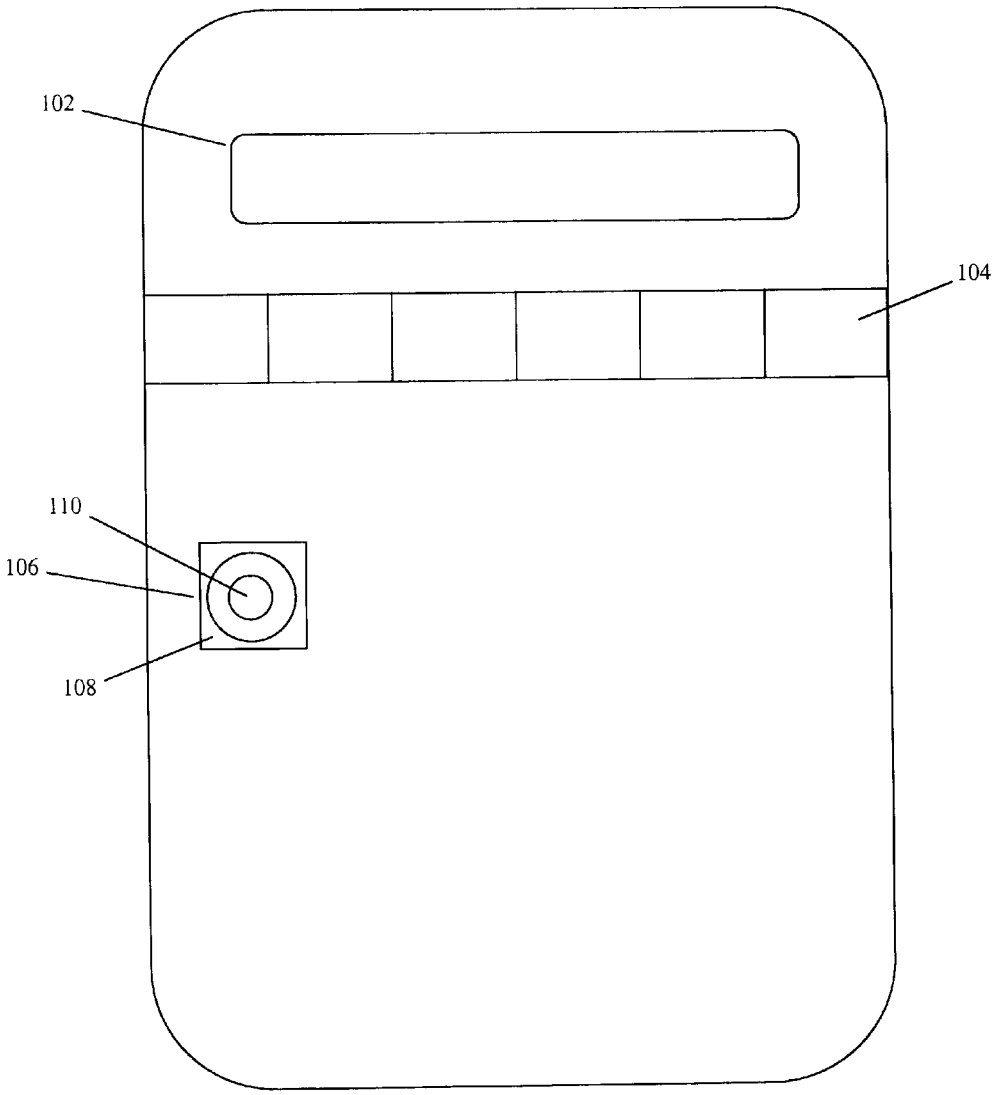
FIG. 1 is a front elevation view of a portable ballistic shield in accordance with principles of the present disclosure.

According to an embodiment of the present disclosure, a ballistic shield is formed of a ballistic material that has a tinted viewing window 102 at the top of the shield, as depicted in FIG. 1. A handle 206 is mounted to the reverse face (rear) of the shield, shown in FIG. 2, so that an operator (e.g., a law enforcement, military or security operator) may hold the shield. The rear of the shield may also house a removable quick release harness 208 that helps the operator to balance the shield for longer uses.

Figure 2:
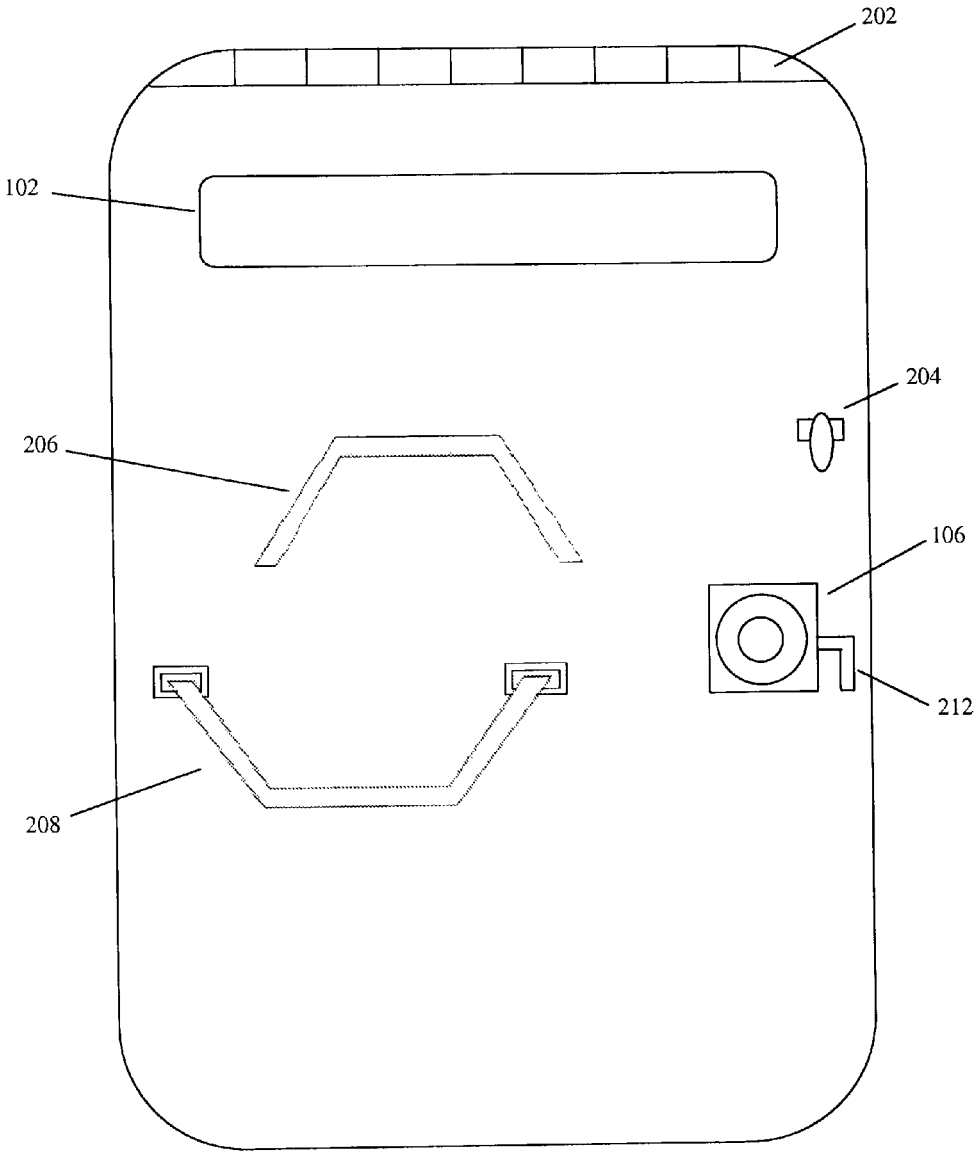
FIG. 2 is a rear elevation view of the ballistic shield of FIG. 1.
Figure 10:
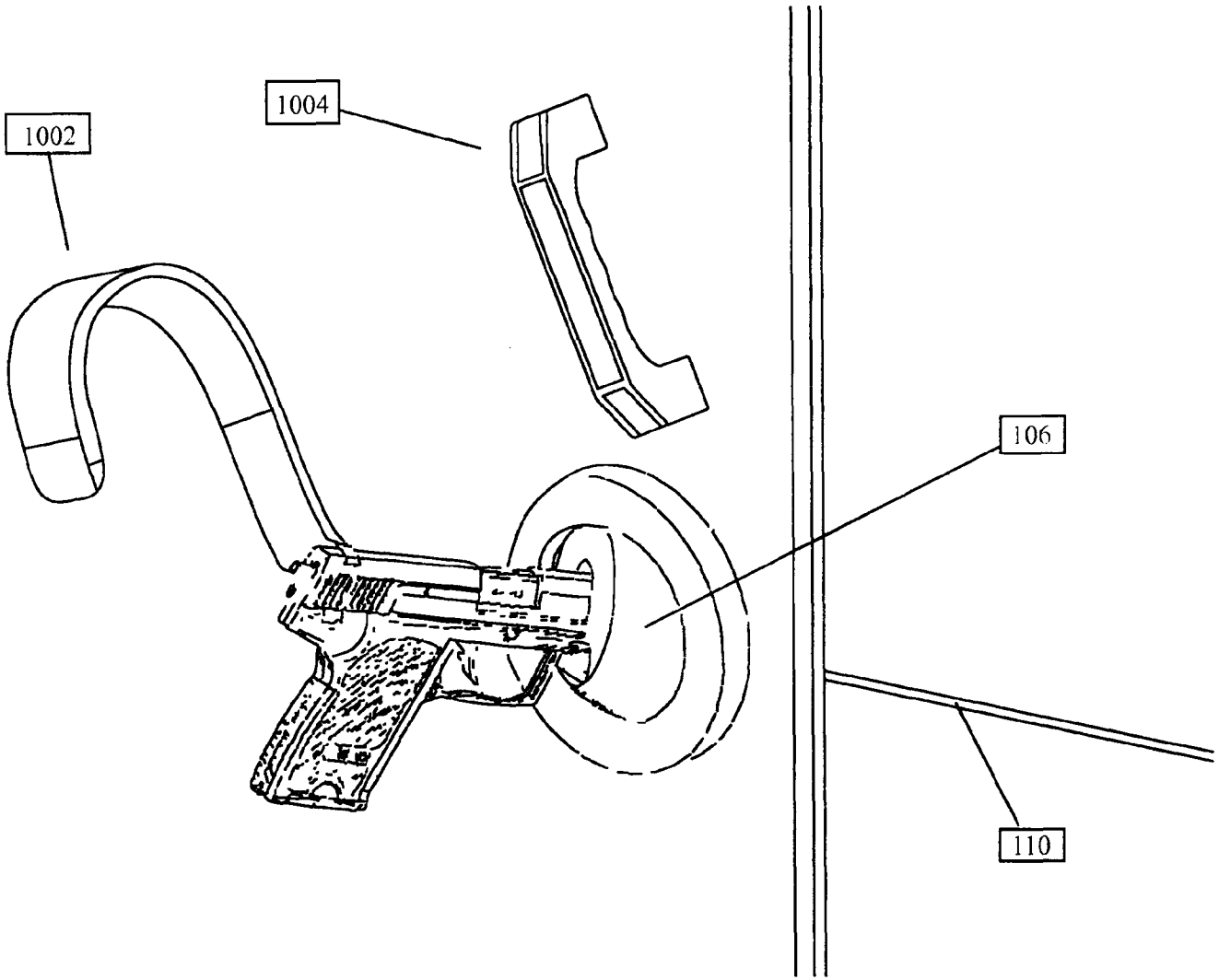
FIG. 10 is a rear perspective view of the ballistic shield of FIG. 9.
Figure 11:
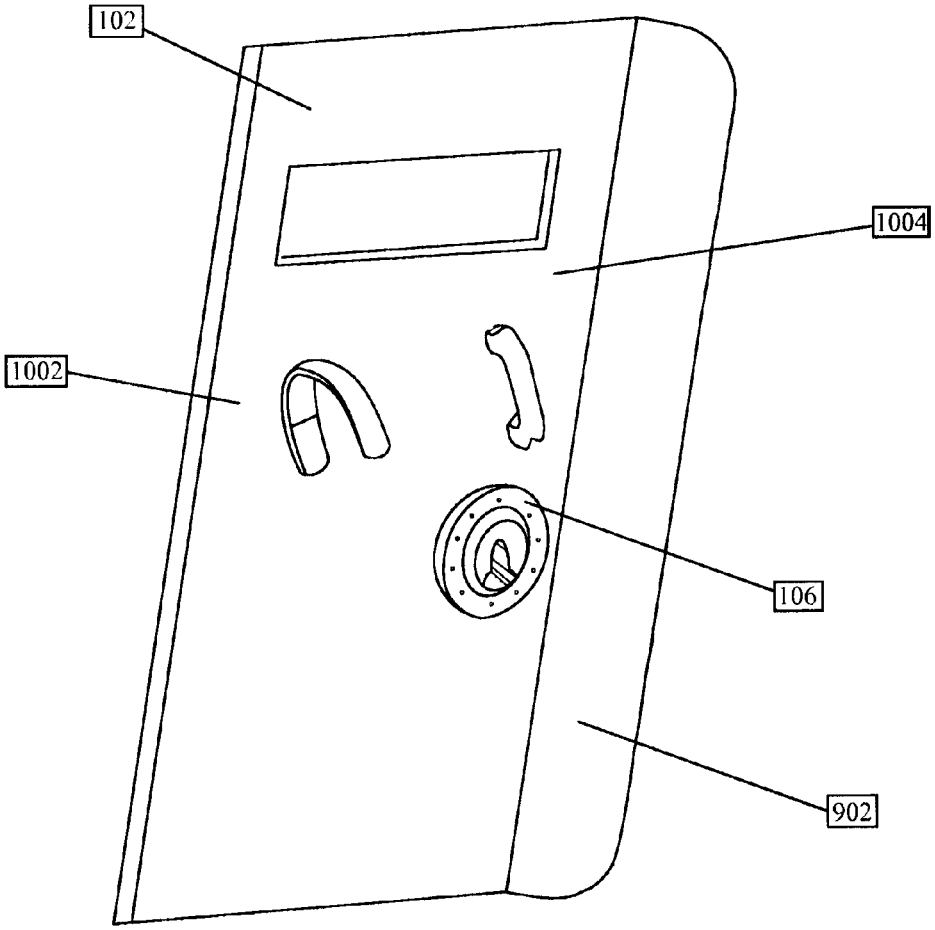
FIG. 11 is a rear perspective view of the ballistic shield of FIG. 9.

In the embodiment depicted in FIG. 2, the ballistic shield uses a handle 206, which is a forearm cuff type. As an alternative example, and as depicted in FIG. 10 and FIG. 11, the ballistic shield may use an open-bottom handle 1002 to allow a user to quickly and easily remove their arm from the handle 1002. Some embodiments may include an additional handle 1004 to improve an operator's grip on the shield.

Referring again to FIG. 1 and FIG. 2, located below the handle 206 is an internal ball turret 106 with a laser 110 housed in the ball turret 106 for aiming the various weapon platforms at the target. The laser 110 can be attached to the weapon using a rail system. In some embodiments, the laser 110 is not a built-in component of the ball turret 106 and can slide onto the weapon. Then, a second rail system on the laser 110 can line up with a rail system on the ball turret 106, and a user can use the laser's second rail system to slide the laser 110 and attached weapon into the ball turret 106. In some embodiments, the laser 110 may be permanently affixed to the ball turret 106 and the weapon will slide directly into the ball turret 106 using the corresponding rail system on the laser 110. Additionally, in some embodiments, the ball turret's rail system enables the weapon to lock into place and stay secure. This can prevent the weapon from improperly firing. In another embodiment, the laser is omitted altogether.

Figure 3:
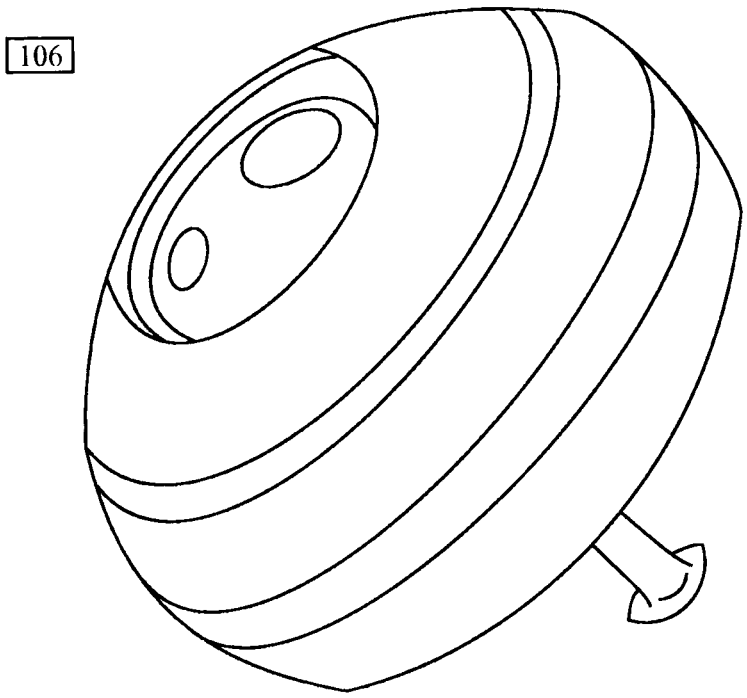
FIG. 3 is a perspective view of the ball turret and protection cover for the ball turret of the ballistic shield of FIG. 1.

In one embodiment, the weapon is secure enough in the ball turret 106 that the ball turret 106 may only permit the slide on the weapon to move back and forth when a shot is fired and a shell case is released. The ball turret 106 may further include a protection cover 108. FIG. 3 is a perspective view of the ball turret 106 and protection cover 108 for the ball turret 106 of the ballistic shield.

Figure 4:
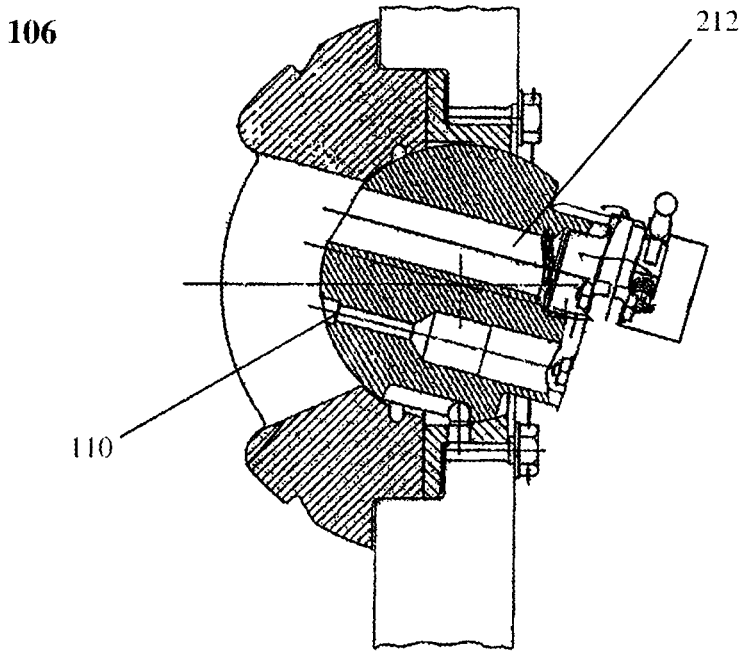
FIG. 4 is a cross-sectional view of a quick release sleeve system of the ball turret of the ballistic shield of FIG. 1.

As depicted in FIG. 4, the internal ball housing also encompasses a quick release sleeve system 212 in the rear of the ball that can hold interchangeable gun sleeves for various weapon platforms that connect to the ball turret 106. The sleeves can, for example, snap onto the accessory rail (e.g., Picatinny rail, weaver mount, under barrel universal rail, etc.). The sleeve can be attached to the ball housing via a locking mechanism in a quick release sleeve system 212 (set screw, over center lever, etc.). FIG. 4 also depicts a possible location of the laser 110.

Figure 5:
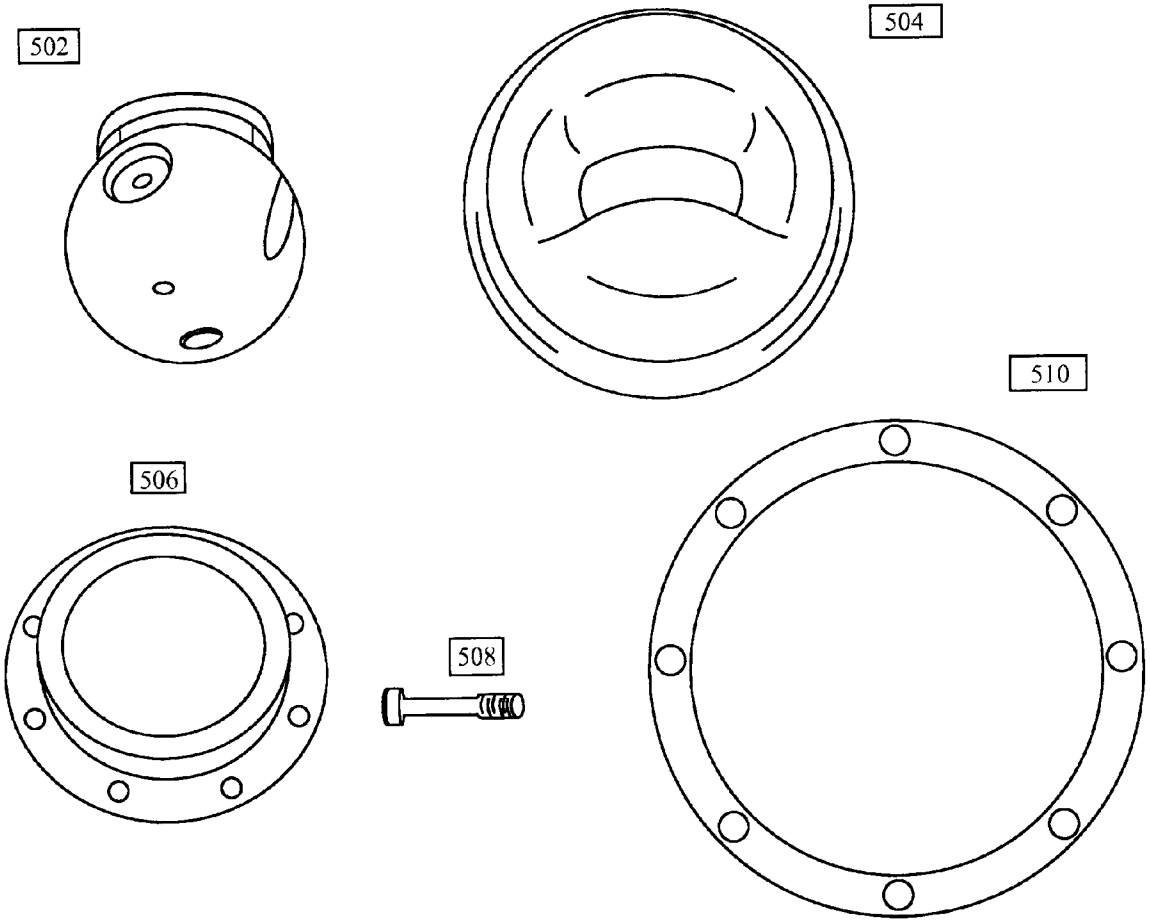
FIG. 5 consists of additional views of the ball turret and protection cover and views of additional components of the ball turret assembly of the ballistic shield of FIG. 1.

FIG. 5 depicts additional views of the ball turret 106 and protection cover 108 and views of additional components of the ball turret assembly of the ballistic shield. The pictured components include a ball mount 502, a cover 504, ball mount hardware 506, a quick release pin 508, and a ball mount washer 510.

In the embodiment depicted in FIG. 1 and FIG. 2, the front top of the shield houses a series of LED disruptor lights 104 that are controlled by a power switch 204 on the rear of the shield; the LED lights' power source 202 is also located on the rear of the shield in this embodiment.

In the depicted embodiment, the ballistic material forming the shield may be selected, preferably, from the group consisting of: boron, carbide, silicon carbide, silicon nitride, aluminum oxide, alumina ceramic, titanium diboride, reinforced fiberglass competitive and mixtures of such materials as well as other rigid, semi-rigid or flexible materials that can withstand some level of bullet impact. The tinted viewing window 102 through the shield may be formed from a material selected from the group consisting of: bulletproof glass and polycarbonate polymers. The interchangeable sleeve is formed, preferably, by a material from the selection of the following groups: plastic, polycarbonate polymers, metal, aluminum.

In the depicted embodiment, the ballistic shield houses an internal ball mount 502 and green or other colored laser 110 that will be formed, preferably, by a material from the following groups: plastic, steel, metal, aluminum, polycarbonate polymers and boron, carbide, silicon carbide, silicon nitride, aluminum oxide, alumina ceramic, titanium diboride, reinforced fiberglass competitive and mixtures of such materials.

As discussed above, the ballistic shield in the depicted embodiment further comprises one or more disruptor lights 104 mounted to the front of the shield. The disruptor lights 104 may be advanced flash bars, LED lights, or strobe lights or halogen lamps or flat panel lights. A shroud can be provided between the disruptor lights 104 and the viewing window 102 to minimize glare back towards the viewing window 102.

The disclosure provides a handheld lightweight ballistic shield comprising a front side and rear side that are formed of a ballistic material; a ballistic tinted viewing window 102 through the shield; a handle 206, 1002, 1004 used for carrying or holding the shield in front of at least a portion of the user's body; and a quick release harness 208 using a nylon-type material that clips around the user's shoulders and arms for additional stabilization. The ballistic shield houses a ball mounting system, the parts of which are illustrated in FIG. 5, with an internal laser 110 used for aiming various interchangeable weapon platforms. The ball mounting system utilizes a quick release sleeve system 212 with interchangeable sleeve (sleeves) for various weapon platforms such as automatic pistols, machine pistols and submachine guns.

In addition, the front shield houses a series of high-density LED disruptor lights 104 used to disorient, blind, and confuse potential attackers. The LED disruptor lights 104 are powered by a battery pack located on the top of the shield that is operated by a power switch 204 that may be, for example, located on the handle 206 of the shield in some embodiments. Alternatively, a power switch 204 located above the ball mounting system, as illustrated in FIG. 6, may activate the battery pack.

Figure 6:
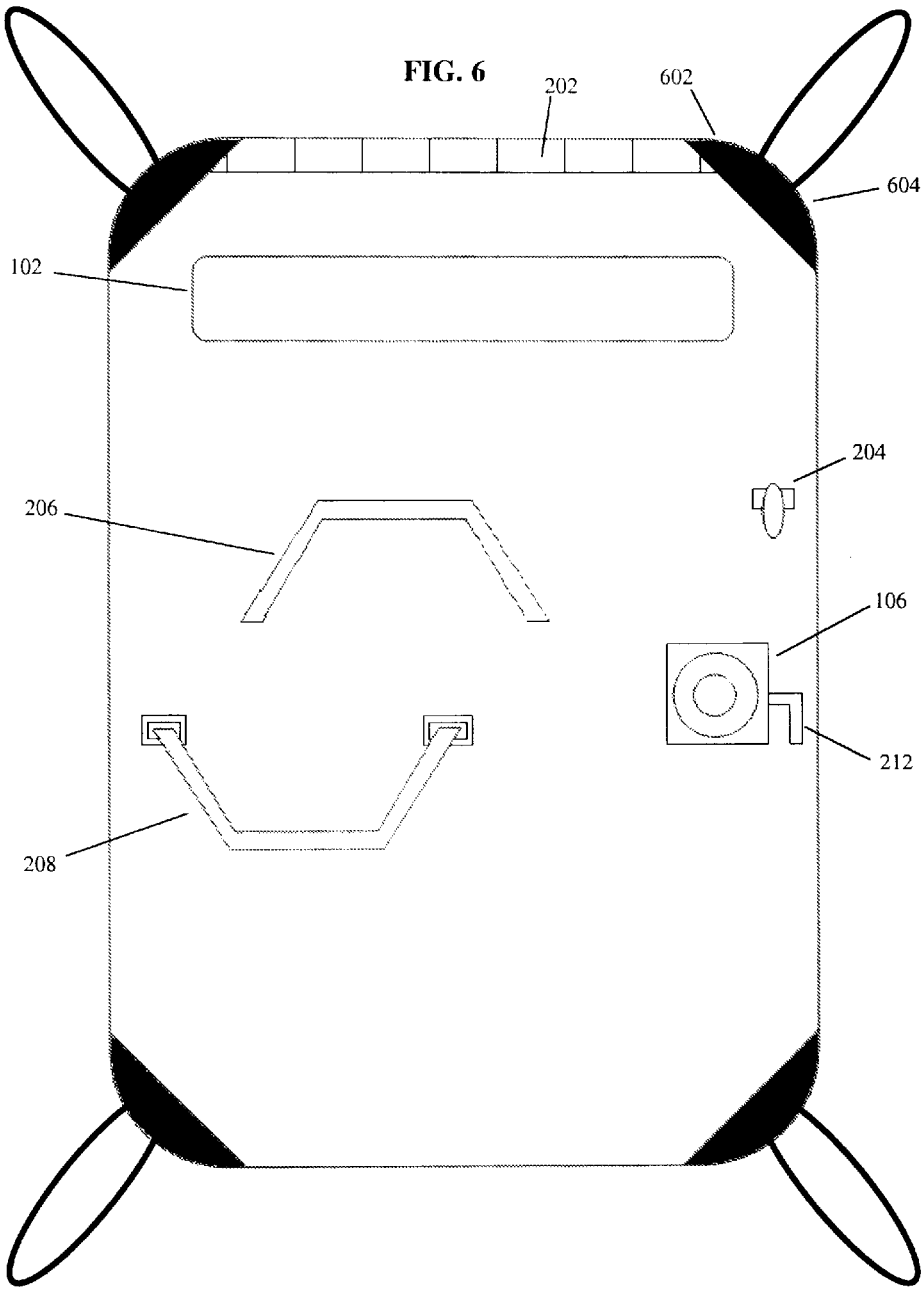
FIG. 6 is a rear elevation view of one embodiment of the ballistic shield of FIG. 1.
Figure 7:
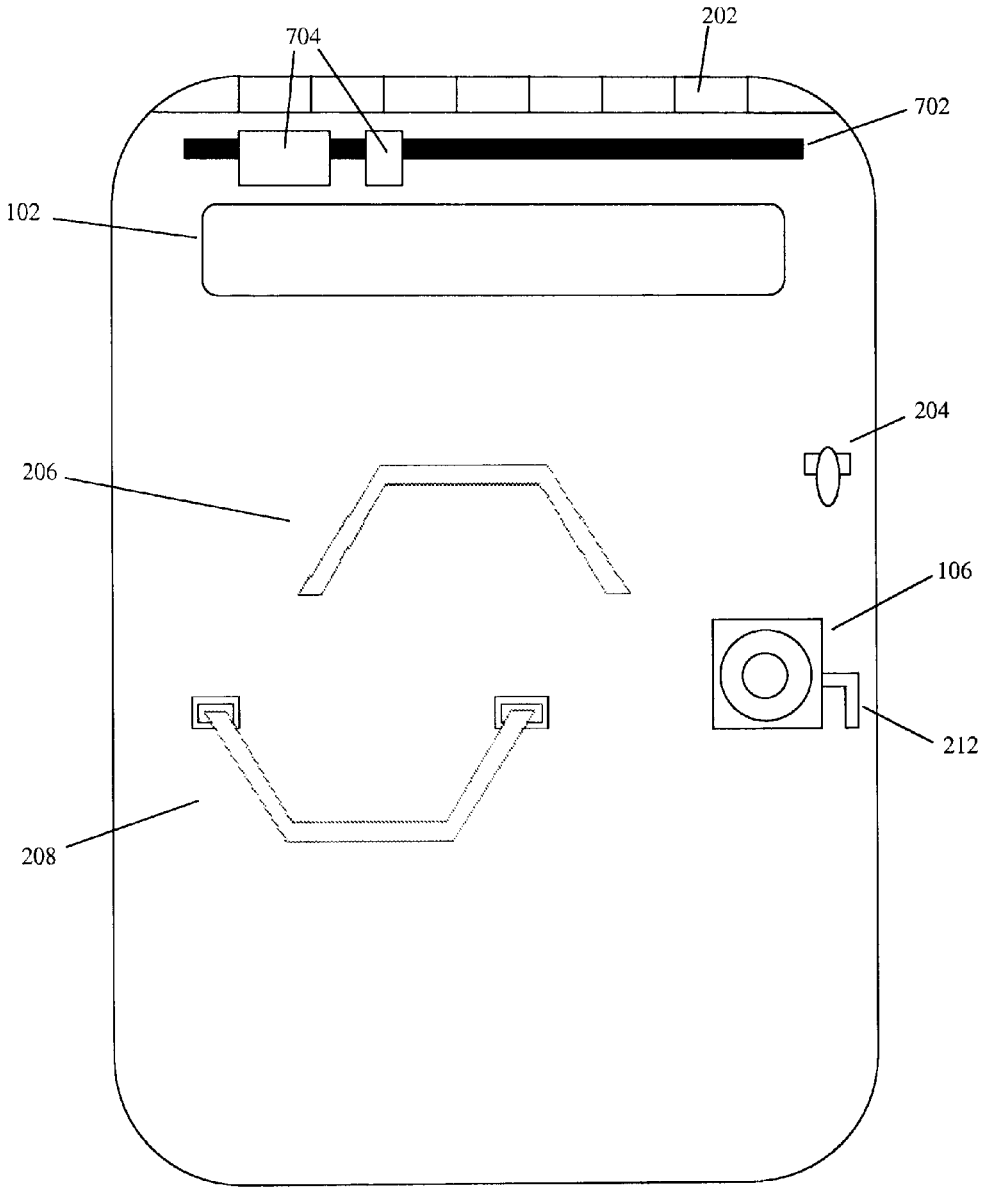
FIG. 7 is a rear elevation view of one embodiment of the ballistic shield of FIG. 1.
Figure 8:
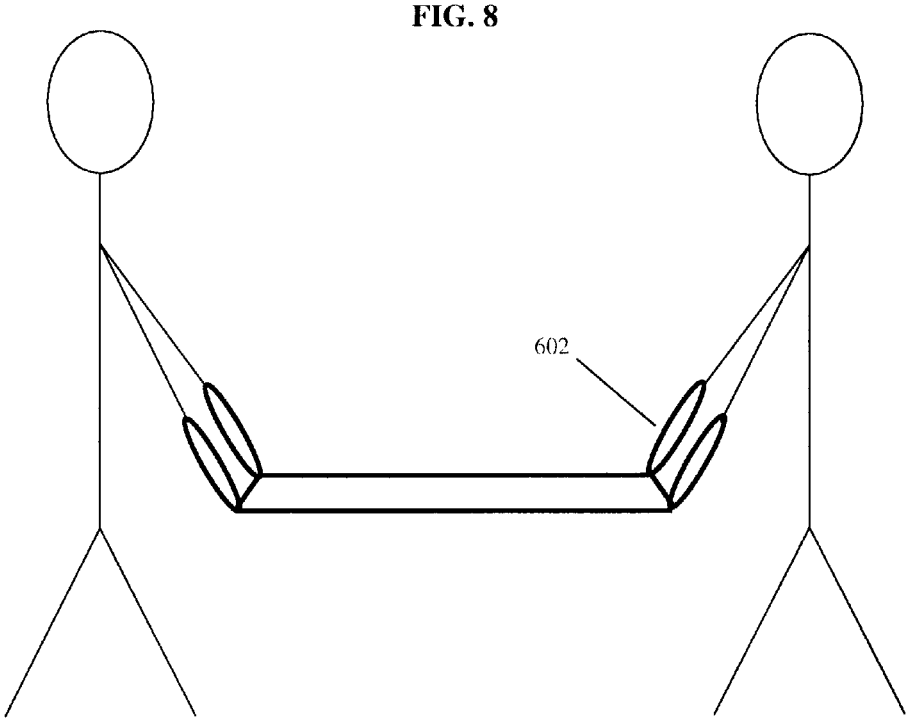
FIG. 8 is a view of one embodiment of the ballistic shield of FIG. 1, wherein the shield is in use as a stretcher in accordance with principles of the present disclosure.

As depicted in FIG. 6, some embodiments of the shield may have four hard points 602 located in each corner of the shield with a reinforced nylon or Kevlar strap 604 that allows the operator to use the shield as a stretcher if a team mate or civilian needs to be evacuated. FIG. 8 depicts use of the disclosed shield as a stretcher in this manner. In addition, the inside top of the shield may have attachment strips 702 that allow for carrying cases 704 to be attached and carried, as depicted in FIG. 7. The attachment strips 702 may be made of Velcro. The carrying cases 704 may be soft pouches. The carrying cases 704 may be used to carry extra pistol, carbine or sub machine gun magazines, flash bang grenades or other tactical items needed by the operator to accomplish his/her mission.

In an embodiment of the present disclosure the viewing window 102 has multi hit capabilities and is 4×16 inches in size, the total weight of the shield is 22 lbs., the height is 36 inches and the width is 26.5 inches, the ballistic glass has a silver coating, and the shield has five LED disruptor lights 104 as depicted in FIG. 1. The size and weight, as well as the number of LED disruptor lights 104 included, may vary. For example, the embodiment depicted in FIG. 9 has three LED disruptor lights 104.

Figure 9:
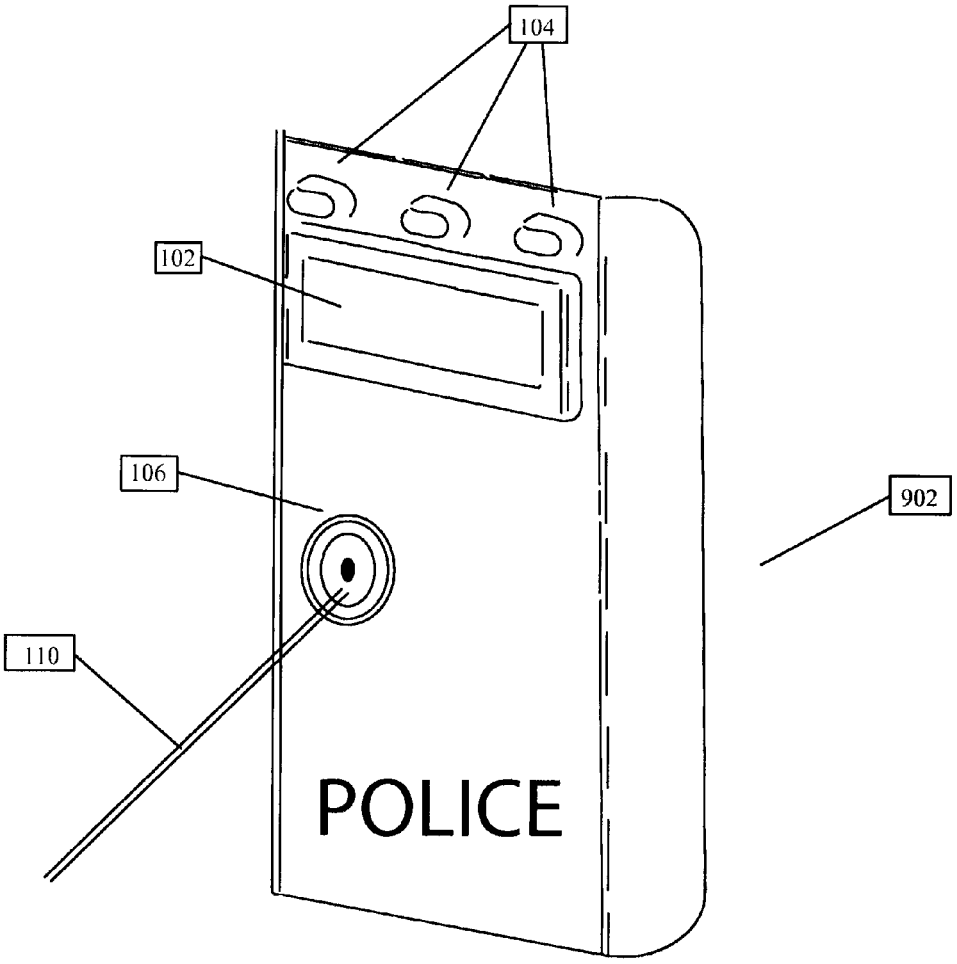
FIG. 9 is a front perspective view of an alternative embodiment of the ballistic shield of FIG. 1 in accordance with principles of the present disclosure.

The disclosed ballistic shield configuration enables an operator to fire from a position wherein the weapon is aligned with the operator's body and head, rather than substantially offset therefrom. In addition, the operator can fire without exposing the operator's hand/arm from behind the shield. As depicted in FIG. 9 and FIG. 11, the shield may also have flared edges 902 on the left and right hand side, which can match the dimensions of common doors found in the United States so that when the operator goes to a knee, the door and shield become a fixed bunker position affording the operator full protection. The flared edges 902 can be modified to the dimensions of doors in other countries, for example, those in Europe, the Middle East or Asia. Alternatively, the shield could have rounded edges or could be flat across the face. In another embodiment, the door itself could serve as a shield, with the ball turret mounted in the door, and further including a viewing aperture to enable aiming and firing accurately from behind the door.

Many embodiments of the invention can be made without departing from the spirit and scope of the invention. For example, the location of the ball turret 106 can vary and the configuration of the turret itself can vary. In addition, the location and configuration of the disruptor lights 104 and the ballistic glass can vary. Many other configurations are possible without departing from the spirit and scope of the invention.

I claim:

1. A ballistic shield for use in high threat areas, the ballistic shield comprising:

a front face;

a reverse face;

a ballistic viewing window;

at least one handle on the reverse face of the ballistic shield; and a ball turret, wherein the ball turret further includes a rail system.

2. The ballistic shield of claim 1, wherein the ball turret further includes a laser.

3. The ballistic shield of claim 1, wherein the ball turret further includes a quick release sleeve system.

4. The ballistic shield of claim 1, further comprising a quick release harness strap on the reverse face of the ballistic shield.

5. The ballistic shield of claim 1, wherein the at least one handle is a forearm cuff handle.

6. The ballistic shield of claim 1, wherein the at least one handle is an open-bottom handle.

7. The ballistic shield of claim 1, wherein the ball turret includes a ball mount, a cover, ball mount hardware, a quick release pin, and a ball mount washer.

8. The ballistic shield of claim 1, wherein the ballistic viewing window is formed from bulletproof glass.

9. The ballistic shield of claim 1, wherein the ballistic viewing window is formed from polycarbonate polymers.

10. The ballistic shield of claim 1, further comprising hard points on each corner of the shield.

11. The ballistic shield of claim 10, further comprising a strap connected to each hard point.

12. The ballistic shield of claim 1, further comprising attachment strips on the reverse face of the ballistic shield, wherein the attachment strips are capable of attaching to at least one carrying case.

13. The ballistic shield of claim 1, further comprising at least one light on the front face of the ballistic shield.

14. The ballistic shield of claim 13, wherein the at least one light is a high-density LED light.

15. The ballistic shield of claim 14, wherein the high-density LED light is a strobe light.

16. The ballistic shield of claim 1, further comprising a left side and a right side.

17. The ballistic shield of claim 16, further comprising flared edges on the left side and the ride side of the ballistic shield.

18. The ballistic shield of claim 1, wherein the ball turret is housed within the front face of the shield.

19. The ballistic shield of claim 18, wherein the ballistic shield is a portable ballistic shield.

* * * * *